US008096353B2

(12) United States Patent
Ver Meer

(10) Patent No.: US 8,096,353 B2
(45) Date of Patent: Jan. 17, 2012

(54) OILFIELD NANOCOMPOSITES

(75) Inventor: Melissa Ver Meer, Shawnee, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/198,259

(22) Filed: Aug. 26, 2008

(65) Prior Publication Data

US 2009/0036605 A1 Feb. 5, 2009

Related U.S. Application Data

(60) Provisional application No. 60/973,327, filed on Sep. 18, 2007.

(51) Int. Cl.
*C08L 23/20* (2006.01)
*E21B 41/00* (2006.01)

(52) U.S. Cl. ..... 166/244.1; 525/55

(58) Field of Classification Search ..... 166/244.1, 166/105; 977/902; 428/402; 524/847; 423/448; 525/55

See application file for complete search history.

(56) References Cited

U.S. PATENT DOCUMENTS

| | | | | |
|---|---|---|---|---|
| 5,839,508 | A * | 11/1998 | Tubel et al. | 166/65.1 |
| 6,787,507 | B1 | 9/2004 | Coveney | |
| 2005/0161212 | A1 | 7/2005 | Leismer | |
| 2007/0003831 | A1* | 1/2007 | Fripp et al. | 429/164 |
| 2007/0092432 | A1* | 4/2007 | Prud'Homme et al. | 423/448 |
| 2007/0131915 | A1* | 6/2007 | Stankovich et al. | 252/511 |
| 2007/0142547 | A1 | 6/2007 | Vaidya | |
| 2008/0020193 | A1* | 1/2008 | Jang et al. | 428/292.1 |
| 2008/0125335 | A1 | 5/2008 | Bhavsar | |
| 2009/0036605 | A1 | 2/2009 | Ver Meer | |

FOREIGN PATENT DOCUMENTS

| | | |
|---|---|---|
| GB | 2410264 | 7/2005 |
| GB | 2433262 | 6/2007 |
| GB | 2443724 | 5/2008 |
| WO | 9931353 | 6/1999 |

* cited by examiner

*Primary Examiner* — Kenneth L Thompson
(74) *Attorney, Agent, or Firm* — Jim Patterson

(57) ABSTRACT

An oilfield apparatus includes an oilfield element made of a composite that includes a matrix material; and a plurality of functionalized graphene sheets dispersed in the matrix material. A method of oilfield operation includes selecting an oilfield apparatus having an oilfield element, wherein at least a portion of the oilfield element is made of a composite comprising a plurality of functionalized graphene sheets dispersed in a matrix material; and using the oilfield apparatus in an oilfield operation, thereby exposing the oilfield element to an oilfield environment. A method for modifying a functionalized graphene sheet includes obtaining the functionalized graphene sheet; and subjecting the functionalized graphene sheet to atom transfer radical polymerization to attach polymers on surfaces of the functionalized graphene sheet. The polymers attached to the surfaces of the functional graphene sheet may comprise co-polymers or magnetic particles.

18 Claims, 3 Drawing Sheets

OILFIELD NANOCOMPOSITES

CROSS-REFERENCE TO RELATED APPLICATIONS

This claims priority to U.S. Provisional Patent Application Ser. No. 60/973,327, filed Sep. 18, 2007, which is incorporated by reference herein in its entirety.

BACKGROUND OF INVENTION

1. Field of the Invention

The invention relates generally to the field of polymer nanocomposites in oilfield applications, and more particularly to the use of functionalized graphene sheets (FGS), also known as thermal exfoliated graphite oxide (TEGO), for use in oilfield applications.

2. Background Art

Oil wells are typically drilled into the underground or subsea formations with depths of a couple miles or more. The environment in these deep wells are very harsh, with temperatures reaching 250° C. or higher and pressures of 20,000 psi or higher. In addition, the downhole environment contains various small molecule gases and liquids. The abilities of these small molecules to penetrate or permeate through polymers or seals are greatly enhanced under the high temperature and high pressure conditions. These conditions post great challenges to various tools and equipment that are used in drilling and exploring these wells, or are placed in the well during production. Many of these tools, pipes, valves, etc. include housings, sleeves, or seals to protect the inside components or to prevent fluid leakages. These devices would need to survive the harsh environment for the duration of their expected service lives. Therefore, materials that can survive the high temperature and high pressure environment are needed for the construction of these oilfield elements. Particularly, materials that can provide effective barriers to fluid permeation or penetration under high temperatures and high pressures are needed.

In recent years, the use of composite materials is gaining popularity. The composite materials typically comprise additives mixed in matrix materials. The additives are selected for their ability to endow or enhance the desired properties of the composites (such as barrier to fluid permeation). Commonly used composites in the oilfield applications, for example, include polymer-based nanocomposites, polymer-organoclays and polymer-carbon nanotubes (CNT) composites.

The use of graphite-containing or graphene-containing composites have also been proposed. Graphene sheets are individual layers of graphite. Each graphene sheet is composed of a honeycomb arrangement of carbon atoms via $sp^2$ bonds. Graphene sheets are expected to have tensile modulus and ultimate strength values similar to that of single wall carbon nanotubes (SWCNT). Graphite is composed of multiple graphene sheets stacked and held together by van der Waal forces. Graphite is significantly cheaper than CNTs. This makes it an attractive material for downhole applications.

In addition, graphite can be modified to change its properties or to further enhance the desired properties. Common approaches to changing the properties of graphite include intercalation and oxidation reactions. For example, Schniepp et al., "*Functionalized Single-Sheet Graphene by Oxidation and Thermal Expansion of Graphite: Exfoliation Mechanism and Characterization*," J. Phys. Chem., B 110, 8535-8539 (2006), discloses the formation of individual chemically modified graphene sheets by oxidation and thermal expansion of graphite. The expansion results from explosive exothermic decomposition of the oxygen-containing functional groups of graphite oxide into $CO_2$ and water. See also, MaAllister et al., "*Functionalized Single-Sheet Graphene by Oxidation and Thermal Expansion of Graphite: Exfoliation Mechanism and Characterization*", 2007 AIChE meeting abstract.

Similarly, Ozbas et al., "*Multifunctional Elastomer Nanocomposites With Functionalized Graphene Single Sheets*", 2007 AIChE meeting abstract discloses functionalized graphene sheets. The functionalized graphene sheets (FGS) are obtained through rapid thermal expansion of graphite oxide. These functionalized graphene sheets have high aspects ratios (100-10000) and specific surface areas (1800 $m^2/g$).

U.S. Patent Application publication No. 2007/0092432, which is incorporated by reference herein in its entirety, also discloses graphite oxides and thermally exfoliated graphite oxides. Graphite oxides are prepared by intercalation and oxidation of natural graphite. The graphite oxides thus formed can be exfoliated by rapid heating to produce the thermally exfoliated graphite oxide (TEGO) in a manner similar to that disclosed by McAllister et al.

The use of graphite or graphene-containing composites in the manufacture of downhole tools or elements have been disclosed in the co-pending U.S. patent application Ser. No. 11/306,119, published as U.S. Application publication No. 2007/0142547. Specifically, this application discloses the use of composites containing graphite nanoflakes or nanoplatelets.

While downhole tools made of graphite or graphene composites have proven useful, there remains a need for better materials and tools for downhole applications.

SUMMARY OF INVENTION

One aspect of the invention relates to oilfield apparatus. An oilfield apparatus in accordance with one embodiment of the invention includes an oilfield element made of a composite that includes a matrix material; and a plurality of functionalized graphene sheets dispersed in the matrix material.

Another aspect of the invention relates to methods for oilfield operations. A method in accordance with one embodiment of the invention includes selecting an oilfield apparatus having an oilfield element, wherein at least a portion of the oilfield element is made of a composite comprising a plurality of functionalized graphene sheets dispersed in a matrix material; and using the oilfield apparatus in an oilfield operation, thereby exposing the oilfield element to an oilfield environment.

Another aspect of the invention relates to methods of modifying functionalized graphene sheets. A method in accordance with one embodiment of the invention includes obtaining the functionalized graphene sheet; and subjecting the functionalized graphene sheet to atom transfer radical polymerization to attach polymers on surfaces of the functionalized graphene sheet. The polymers attached to the surfaces of the functional graphene sheet may comprise co-polymers or magnetic particles.

Other aspects and advantages of the invention will be apparent from the following description and the appended claims.

DETAILED DESCRIPTION

Figure 1:
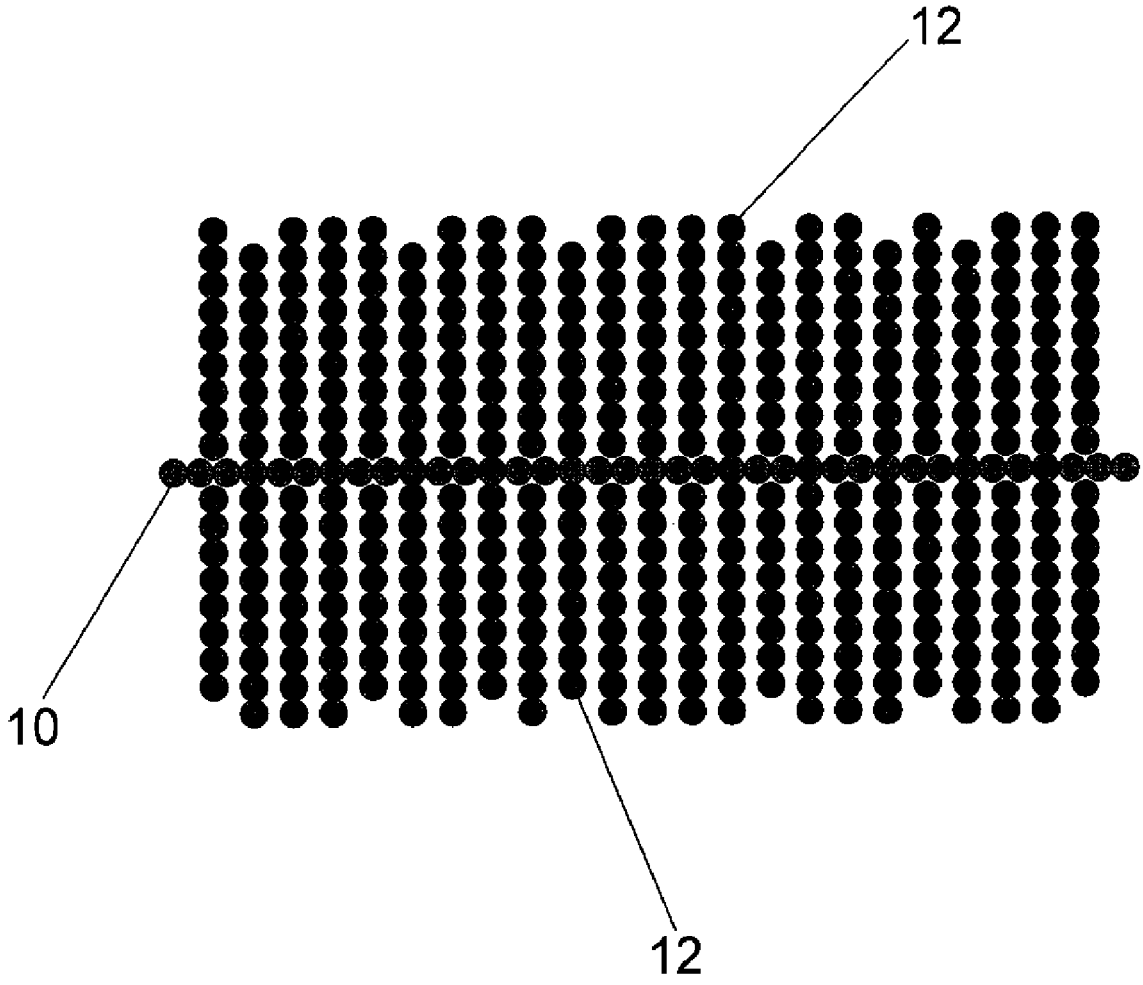
FIG. 1 a functionalized graphene sheet that has been derivatized with polymers on both surfaces using atom transfer radical polymerization in accordance with one embodiment of the invention.

Embodiments of the invention relate to downhole tools made of composites that contain functionalized graphene sheets (FGS). Examples of functionalized graphene sheets, for example, include graphite oxide (GO), thermally exfoliated graphite oxide (TEGO), and graphene sheets modified with other groups (such as alkyl groups to enhance mixability with polymer resins). In addition, functionalized graphene sheets may be further modified with atom transfer radical polymerization to change their properties. Oilfield apparatus or tools having elements made with composites containing functionalized graphene sheets would have improved properties that make them suitable for downhole applications. Particularly, composites containing functionalized graphene sheets can provide better barrier to permeation or penetration by downhole fluids.

As noted above, the harsh environment downhole requires that downhole tools be made of materials that can withstand high temperatures and high pressures. In addition, the materials used for seals or containers are preferably resistant to permeation by small molecules (such as methane, $CO_2$, or fluids) under the downhole conditions. Advances in polymer nanocomposites makes it possible to push the capability of downhole tools, cables, sensors and other general components to the next level, increasing the product's overall temperature capability, gas permeability resistance, chemical resistance, dielectric properties, and physical properties including impact resistance.

One type of promising nanocomposites comprises graphene platelets or flakes, as disclosed in the published U.S. Patent Application No. 2007/0142547 ("the '547 application"), which is assigned to the assignee of the present invention and is incorporated by reference in its entirety. These graphene nanoplatelets or nanoflakes disclosed in the '547 application are prepared from unmodified graphite. Embodiments of the invention include nanocomposites that contain functionalized graphene sheets (FGS). These functionalized graphene sheets may have improved properties that make it easier to disperse them in a polymer matrix. In addition, the functionalized graphene sheets may confer or enhance the desired properties to the polymer matrix.

Functionalized graphene sheets can be prepared (i.e., chemically modified) from graphite. Graphite contains graphene sheets held together by van der Waals forces to form layered or stacked structures. Therefore, graphite has anisotropic mechanical properties and structure. Unlike the strong $sp^2$ covalent bonds within each layer, the van der Waals forces holding the graphene layers in the stack are relatively weak. The weak van der Waals forces allow other molecules to penetrate between the graphene layers in graphite. This penetration by other molecules is referred to as intercalation.

Some embodiments of the present invention involves modifying graphite to form graphite oxide. Preparation of graphite oxide from graphite involves intercalation and oxidation, which have been described in the literature. Intercalation involves guest materials inserting into graphite between the graphene layers, creating separations of the graphene sheets. The intercalation causes the distances between the graphene sheets to be larger than the 0.34 nm spacing of native graphite. In addition to graphite, other layered materials may also form intercalation compounds, including boron nitride, alkali metal oxides and silicate clays.

The intercalation process may involve chemical reaction and/or charge transfer between the layered host material and the reagent, resulting in the insertion of new atomic or molecular intercalating layers. For example, graphite materials may be intercalated with sulfuric acid in the presence of fuming nitric acid to yield expanded graphitic material. These expanded materials may be heated to increase the spacings between the graphene layers, i.e., the spacings in the c-axis direction. The intercalation may result in deformation or rumpling of the carbon layer by the intercalating agent. A local buckling of the carbon layers may also occur. This process results in partial oxidation of graphite to produce graphite oxide (GO).

Some embodiments of the invention use exfoliated graphite oxide. Processes for making exfoliated (expanded) graphite materials are known and typically use rapid heating. These processes may produce individual graphene layers (or several thin layers sticking together). Thus, the products are usually referred to as thermally exfoliated graphite oxide (TEGO). Functionalized graphite oxide, including graphite oxide and TEGO, have many applications, including electromagnetic interference shielding, oil spill remediation, and sorption of biomedical liquids.

The above describes a general approach to the preparation of graphite oxide (GO) and thermally exfoliated graphite oxide (TEGO). Several other methods are known in the art and may be used to prepare the functionalized graphene sheets for embodiments of the invention. For example, graphite oxide may be made by mixing crystalline graphite with $H_2SO_4$, $NaNO_3$ and $KMnO_4$ overnight. Then, the content is mixed with water for further reaction, and finally rinsed with methanol. See, "Hummer's method" disclosed in Hummers, W.; Offeman, R., "*Preparation of Graphite Oxide*," J. Am. Chem. Soc. 1958, 80, 1339. Other examples include those disclosed in U.S. Patent Publication No. 2007/0092432, and Cai et al., "*Preparation of fully exfoliated graphite oxide nanoplatelets in organic solvents*," J. Mater. Chem., 2007, 17, 3678-3680.

The resulting functional groups in graphite oxide (from intercalation and oxidation) may be hydroxyl, epoxy, and carboxylic groups, or a combination thereof. These polar functional groups facilitate the retention of water molecules in the spacing between the graphite oxide layers. Rapid heating (e.g., at a rate of about 2000° C./min or faster) of the resultant graphite oxide in an inert atmosphere (e.g., inert gas such as nitrogen, argon, or a mixture thereof) would result in superheating and volatilization of the intercalating agent and imbibed solvent (e.g., water or a mixture of water with water-soluble solvents). The inert atmosphere used in the heating process may be nitrogen, argon or mixtures thereof. In addition, reducing atmospheres may be used, such as carbon monoxide, methane or mixtures thereof. In this case, the GO may be partially reduced and become electrically conductive.

As a result of the rapid heating and volatilization, gases (such as $CO_2$) from chemical decomposition of the oxygen-containing species in the graphite oxide may evolve, thereby generating pressures to separate or exfoliate the graphite oxide sheets. The term "exfoliate" refers to the process of going from a layered or stacked structure to one that is substantially de-laminated or no longer stacked. While most exfoliated graphene sheets may contain single layer, embodiments of the invention may also use exfoliated graphene sheets that contain a few layers (say, 2, 3 or more layers) still stuck together.

The above described procedure first prepares graphite oxide, then exfoliated the resultant graphite oxide. An alternative approach is to oxidize graphene sheets that have been exfoliated from graphite. For example, Ramesh et al., "*Preparation and physicochemical and electrochemical characterization of exfoliated graphite oxide*," Journal of colloid and interface science, 2004, vol. 274, No. 1, pp. 95-102, discloses a method, in which exfoliated graphite oxide (EGO) is prepared by oxidizing exfoliated graphite (EG) using a mixture of $KMnO_4/H_2SO_4$. Embodiments of the invention may use exfoliated graphite oxide prepared with either approach.

The exfoliated (de-laminated) graphite oxide sheets (TEGO) may appear as fluffy, low density materials. These are mostly single-layer sheets. However, some of them may include a few layers. These exfoliated graphite oxide sheets, like graphite nanoflakes or nanoplatelets, have high aspect ratios (e.g., >100) because they are typically single layers of carbon networks held together by $sp^2$ bonds. In addition, they also have large surface areas per unit weight (e.g., >300 $m^2/g$). These TEGO can be readily dispersed in polar solvents and polymers. Therefore, they can be used, for example, in composites as nanofillers.

The polar functional groups on graphite oxide or TEGO may be further functionalized (derivatized), using molecules that are reactive toward these polar functional groups. More than one type of functional groups may be included. The polar groups on graphite oxide or TEGO may include hydroxyl, epoxy groups and carboxylic acid groups or their derivatives. Depending on the types of the polar groups, the reactants chosen will be different. For example, alkyl amines and dialkyl amines can be used to react with epoxides. This reaction may add hydrophobicity to the surface or may be used to covalently crosslink the TEGO surfaces. For hydroxyl groups on the GO or TEGO, acid chlorides can be used, which would add an alkyl group linked by an ester group. Similarly, reactions of amines or hydroxyls with carboxylic acids can be used to attach groups to make the surface more hydrophobic by adding alkyl groups. Thus, the surfaces of TEGO may be made more hydrophilic by adding ethylene oxide, primary and secondary amines, and acid functionality, for example, using the chemistries mentioned above.

In addition, modification of TEGO may include the grafting of species on the surface to increase the cohesive interactions between the filler surface and polymer matrices. The grafting agents, for example, may include low molecular weight analogs of the polymer matrix phase or polymers with the same composition as the matrix phase that have reactive functionality. Matrix polymer with reactive functional groups may include polyethylene or polypropylene copolymers of vinyl acetate or maleic anhydride or their mixtures. These grafting or modifications may enhance the compatibility between functionalized graphene sheets and matrix polymers.

In addition to the above described modification (i.e., attaching additional groups onto the graphene sheets), the functionalized graphene sheets may also act as substrates for in situ polymer growth. Various methods for "growing" the polymers onto such functionalized graphene sheets may be used, including atom transfer radical polymerization (ATRP). ATRP is a controlled radical polymerization, in which there are always at least a small degree of chain termination events. ATRP enables controlled chain growth for the synthesis of low polydispersity index polymers in a variety of architectures including copolymers, block copolymers, and stars.

Because FGS have sites for chemical bonding, atom transfer radical polymerization (ATRP) is possible. This may allow polymer chains, such as polystyrene and other ATRP-ready polymers, to be grown from the surface of FGS. Polymer chains may also include co-polymers or magnetic particles, for orientation of the FGS in either the extrusion process or solution-based drying process.

As illustrated in FIG. 1, ATRP may be used to "grow" short polymer chains 12 onto the surfaces of a functionalized graphene sheet 10. The final product resembles a fuzzy two-sided carpet, with polymer piles extruding from both sides of the base layer. The large aspect ratio of functionalized graphene sheets may cause these sheets to behave like tissue papers, folding upon themselves. The folded functionalized graphene sheets may lose some desired properties (e.g., barrier properties). With such polymers attached to the surfaces, the functionalized graphene sheets may have enhanced stiffness that may prevent folding upon themselves and facilitate their dispersion during mixing or blending with the matrix polymers, such as elastomers.

Embodiments of the invention relate to composites that have functionalized graphene sheets mixed in a matrix material. The exfoliated graphene sheets have large aspect ratios (width versus thickness) because they are essentially a single (or a few) atom layer thick. When these thin sheets are dispersed in a matrix material, they can create a barrier layer in the composite. Thus, an article prepared with such composites will have enhanced resistance to permeation by gases or liquids. Mixing of functionalized graphene sheets (e.g., TEGO) with matrix materials (e.g., polymers or elastomers) may be accomplished with any mixing technique know in the art. Such techniques may include, for example, single screw extrusion, twin screw extrusion, mixing bowl, ball mixer, or other mechanical mixer.

As used herein the term "graphitic" means a composition having a graphitic structure, more generally known as an $sp^2$ structure formed from one or more elements along the second row of the Periodic Table of the Elements, such as boron, carbon, and nitrogen, that has had its layers separated by one or more thermal, chemical, and/or or physical methods. Examples include functionalized graphene sheets, expanded graphite, exfoliated graphite (which is known in the art as simply a form of expanded graphite), compositions based on boron and nitrogen, such as boron nitride (also known as hexagonal BN or "white graphite"), and the like. Boron nitrides have high thermal conductivity and are electrically insulating (dielectric constant ~4) as opposed to graphite, which is electrically conductive. Boron nitrides also exhibit low thermal expansion, are easily colorable, and chemically inert. Expanded graphite is an expanded graphitic including carbon in major proportion, derived from graphite, substituted graphite, or similar composition. The differing electrical conductivities of functionalized graphene sheets, expanded graphite and expanded boron nitrides may offer a way to adjust the electrical conductivity of the polymeric matrix without changing the barrier properties significantly. Embodiments of the invention may use exfoliated graphene sheets based on boron nitride (BN). Thus, the term "graphene sheets" as used herein includes not only carbon based graphite material, but also boron nitride based materials.

The term "nanoflake" is described in U.S. Pat. No. 6,916,434. Nanoflakes are flake-like graphite sheets, which may be in a patchwork or papier-mâché like structure. Similarly, the term "nanoplatelet" has been described in U.S. Pat. No. 6,672,077. Nanoplatelets may include thin nanoplatelets, thick nanoplatelets, intercalated nanoplatelets, having thickness of about 0.3 nm to about 100 nm, and lateral size of about 5 nm to about 500 nm are described.

In the present application, the phrase "functionalized graphene sheets, expanded graphitic nanoflakes and/or nanoplatelets" may include curved contours. In other words, some or all of the expanded graphitic nanoplatelets or nanoflakes (or portions thereof) may have 3-dimensional shapes other than flat. As an example, the functionalized graphene sheets or expanded graphitic nanoflakes useful in embodiments may be shaped as saddles, half-saddles, quarter-saddles, half-spheres, quarter spheres, cones, half-cones, bells, half-bells, horns, quarter-horns and the like, although the majority of each nanoflake, and the majority of nanoflakes as a whole may be flat.

As noted above, the functionalized graphene sheets, expanded graphitic nanoflakes and/or nanoplatelets may have high aspect ratio, exceeding 100 or 200. The high aspect ratio means that only a small amount of the FGS is needed in a composite to provide effective barrier to gas or liquid permeation. The shapes of the functionalized graphene sheets, nanoflakes and/or nanoplatelets may vary greatly, for example hexagonal, circular, elliptical, rectangular, etc. The aspect ratio and shapes which are most advantageously employed may depend on the desired end-use. Embodiments may be used in oilfield applications for enhanced permeation resistance, and enhanced resistance to diffusion of gases and liquids at downhole conditions.

In addition, various nanoflake and nanoplatelet structures useful in embodiments can assume heterogeneous forms. Heterogeneous forms include structures wherein a portion of which may have a certain chemical composition and another portion may have a different chemical composition. An example may be a nanoflake having two or more chemical compositions or phases in different regions of the nanoflake. Heterogeneous forms may include different forms joined together, for example, where more than one of the above listed forms are joined into a larger irregular structure. For example, a "Frisbee," wherein a major portion is flat, but may have a curved edge around the circumference. Moreover, all nanoflakes and nanoplatelets may have cracks, dislocations, branches or other imperfections.

Embodiments of the invention may use polymers, elastomers, or ceramic as the matrix materials. The polymeric matrix materials may include one or more polymers selected from natural and synthetic polymers, including those listed in ASTM D1600-92, "Standard Terminology for Abbreviated Terms Relating to Plastics", and ASTM D1418 for nitrile rubbers, blends of natural and synthetic polymers, and layered versions of polymers, wherein individual layers may be the same or different in composition and thickness.

The polymeric matrix may comprise one or more thermoplastic polymers, such as polyolefins, polyamides, polyesters, thermoplastic polyurethanes and polyurea urethanes, copolymers, and blends thereof, and the like; one or more thermoset polymers, such as phenolic resins, epoxy resins, and the like, and/or one or more elastomers (including natural and synthetic rubbers), and combinations thereof.

Functionalized graphene sheets of the invention include those wherein at least a portion of the functionalized graphene sheets, expanded graphitic nanoflakes and/or platelets are surface modified to enhanced permeation resistance when dispersed in the polymeric matrix. For example, attaching functional groups on graphite nanoflakes and/or nanoplatelets may increase the bound rubber/polymer content in the resultant polymeric matrix, which may enhance the permeation resistance of the resultant oilfield element. Functional groups that may enhance the bound polymer content will depend on the type of polymer or polymers comprising the polymeric matrix. For example, in polymers containing nitrile groups, the introduction of carboxyl and/or hydroxyl groups may enhance the bound polymer content. Embodiments include those apparatus wherein the polymeric matrix comprises expanded graphitic nanoflakes and/or nanoplatelets having high aspect ratio and surface modification.

Some embodiments of the invention relate to downhole tools or apparatus having elements made of composites that contain functionalized graphene sheets, such as exfoliated graphite oxide (e.g., TEGO) or other functionalized graphene sheets. These tools or apparatus have improved performance due to the inclusion of elements made of functionalized graphene sheets. By combining the properties of polymers with the properties of functionalized graphene sheets, (e.g., TEGO), the composites will have new or improved properties. These composites may be referred to as nanocomposites due to the size of the functionalized graphene sheets, which may be in the form a of nanoflakes and/or nanoplatelets.

The nanocomposites may include a matrix material and a plurality of functionalized graphene sheets, nanoflakes, or nanoplatelets. The functionalized graphene sheets and the matrix materials may act together to increase the barrier, mechanical, and/or electrical properties of oilfield elements. In particular, functionalized graphene sheets may offer enhanced resistance to permeation by well fluids when incorporated into polymers. That is, the platelets or flakes of the functionalized graphene sheets may provide resistance to diffusion and reduce the permeability of well fluids (gases and liquids) through the polymer nanocomposite.

The matrix materials may include elastomers, thermoplastic polymers, thermoset plastic polymer, ceramic, and the like. The elastomer composites may contain natural rubber, synthetic rubber, or other elastomers. The oilfield elements including elastomers may be for use with packers, cables, seals, seats, and other oilfield rubber compounds. The thermoplastic composites may include blends with self-reinforced polyphenylene (SRP), polyetheretherketone (PEEK), polybenzimidazole (PBI), polyimide (PI), liquid crystal polymers (LCP), polypropylene (PP), polyethylene (PE), cross-linked polyetheretherketone (XPEEK) and other polymers. Additionally, embodiments may also include a use of FGS in conductive oils, plastics, and other electronic devices for oilfield applications.

An oilfield element refers to any device (or parts thereof) used in an oilfield operations. For example, an oilfield element may be a tube, a valve, a sensor, or parts thereof. Other examples of an oilfield element may include packer elements, submersible pump motor protector bags, sensor protectors, blow out preventer elements, sucker rods, O-rings, T-rings, gaskets, pump shaft seals, tube seals, valve seals, seals and insulators used in electrical components, such as wire and cable semiconducting shielding and/or jacketing, which may inhibit the diffusion of gases such as methane, carbon dioxide, and hydrogen sulfide from well bore, through the cable and to the surface, power cable coverings, seals and bulkheads such as those used in fiber optic connections and other tools, and pressure sealing elements for fluids (gas, liquid, or combinations thereof).

As an example, an oilfield tool or apparatus of the invention may be a submersible pump, which includes a motor protector that may or may not be integral with the motor, wherein the motor protector is an oilfield element that is made, entirely or partially, of a nanocomposite described above. In this case, the motor protector is expected to have better resistance to fluid permeation due to the inclusion of functionalized graphene sheets. Thus, the useful life of the submersible pump could be extended.

Some embodiments of the invention relate to oilfield assemblies for exploring for, testing for, or producing hydrocarbons. For example, an oilfield assembly may include one or more oilfield devices or apparatus, wherein one of the devices or apparatus includes an oilfield element that is made of a nanocomposite, comprising a matrix material and a plurality of functionalized graphene sheets, expanded graphitic nanoflakes and/or nanoplatelets dispersed therein.

Figure 2:
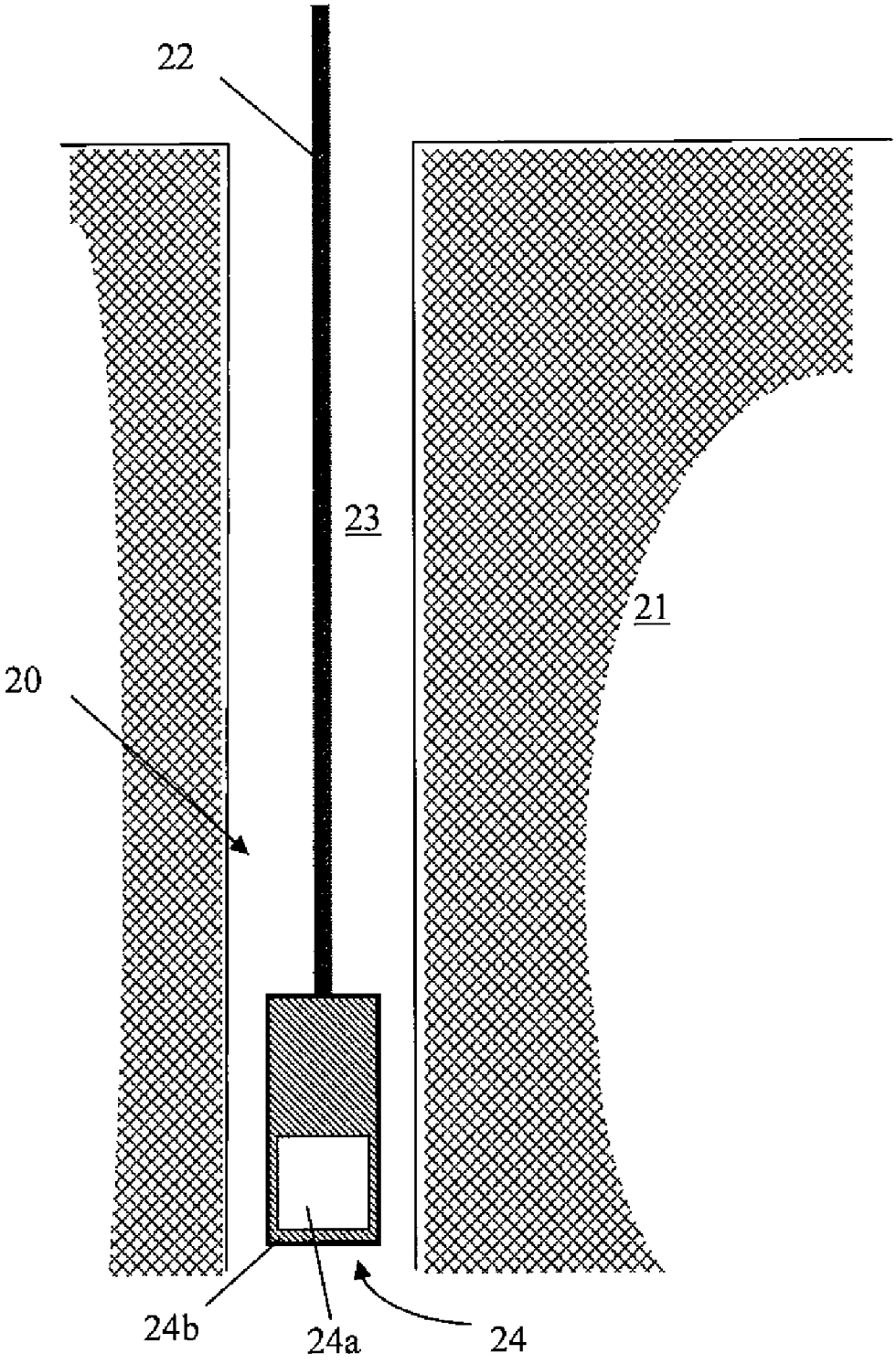
FIG. 2 shows an oilfield apparatus disposed in a wellbore in accordance with one embodiment of the invention. The apparatus includes an oilfield element made of a composite that comprises functionalized graphene sheets.

For example, FIG. 2 shows a downhole assembly 20 disposed in a wellbore 23 that penetrates a formation 21. The downhole assembly 20 is suspended by a cable 22. The downhole assembly 20 may include a device/apparatus 24, which for example may be an electronic submersible pump. Using a submersible pump as an example, the apparatus 24 may include a pump 24*a* protected by an enclosure 24*b*. In accordance with embodiments of the invention the enclosure 24*b* may be made of a composite that includes functionalized graphene sheets.

Figure 3:
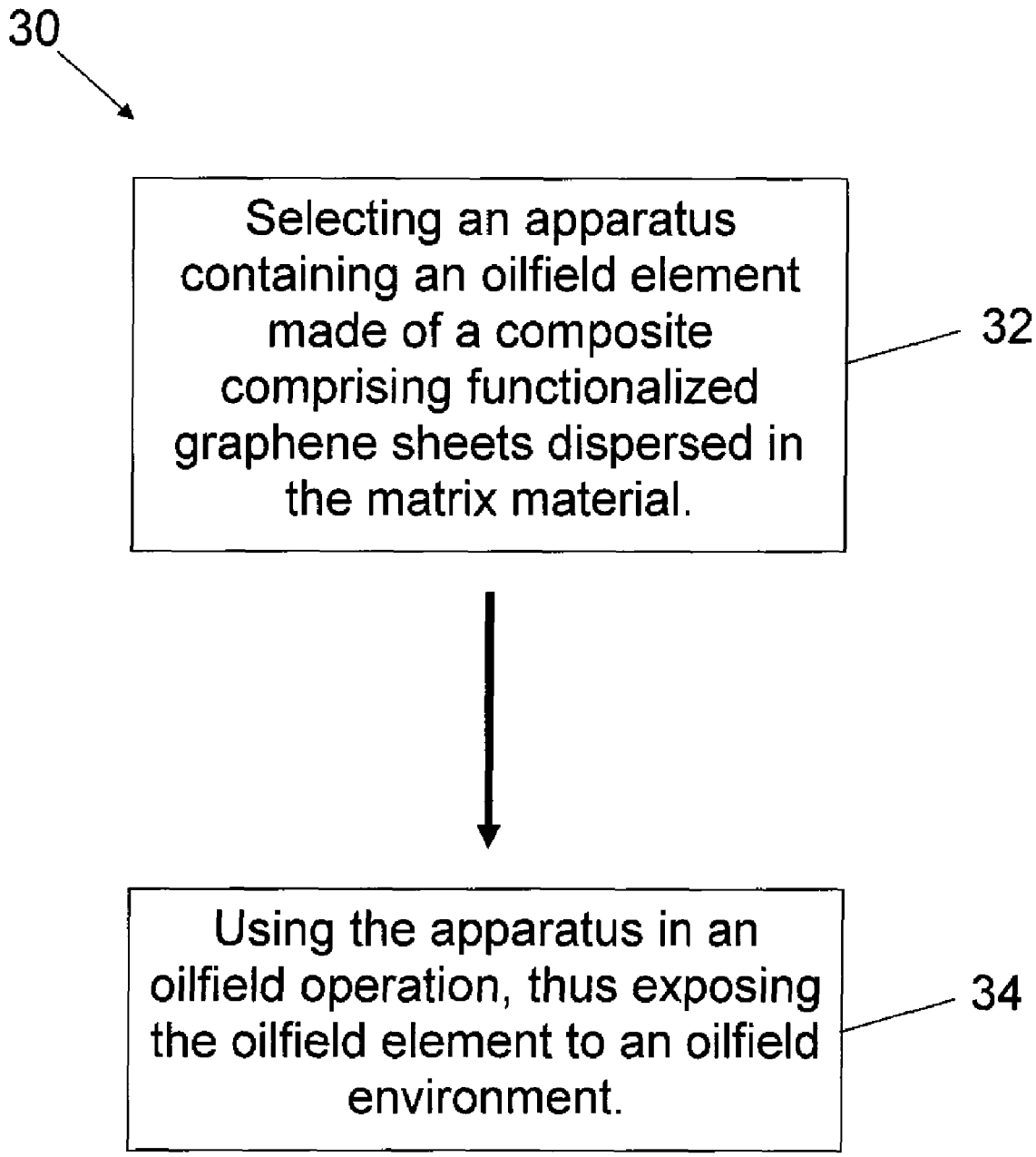
FIG. 3 shows a flowchart illustrating a method in accordance with one embodiment of the invention.

Some embodiments of the invention relate to methods for exploring for, drilling for, or producing hydrocarbons. As illustrated in FIG. 3, a method 30 in accordance with embodiments of the invention may include: (a) selecting an apparatus having an oilfield element made of a nanocomposite that comprises a matrix material and a plurality of functionalized graphene sheets (step 32); and (b) using the apparatus in an oilfield operation, thus exposing the oilfield element to an oilfield environment (step 34).

Methods may include, but are not limited to, running an apparatus containing an oilfield element made of the above-described nanocomposites into a wellbore, and/or retrieving the apparatus containing the oilfield element from the wellbore. The oilfield environment during running and retrieving may be the same or different from the oilfield environment during use in the wellbore or at the surface.

Exposed surfaces of an oilfield element of the invention may optionally have a polymeric coating thereon, wherein the polymeric coating may be a condensed phase formed by any one or more processes. The coating may be conformal (i.e., the coating conforms to the surfaces of the oilfield element, which serves as a substrate for the coating), although this may not be necessary in all oilfield applications or all oilfield elements, or on all surfaces of the polymeric matrix. The coating may be formed from a vaporizable or depositable and polymerizable monomer, as well as particulate polymeric materials. The polymer in the coating may or may not be responsible for adhering the coating to the polymeric matrix, although the application does not rule out adhesion aids, which are further discussed herein. A major portion of the polymeric coating may comprise a carbon or heterochain chain polymer. Useful carbon chain polymers may be selected from polytetrafluoroethylene, polychlorotrifluoroethylene, polycyclic aromatic hydrocarbons such as polynaphthalene, polyanthracene, and polyphenanthrene, and various polymeric coatings known generically as parylenes, such as Parylene N, Parylene C, Parylene D, and Parylene Nova HT.

Oilfield elements made of composites that comprises matrix material and functionalized graphene sheets, expanded graphitic nanoflakes and/or nanoplatelets may inhibit the diffusion and permeation of fluids when used in downhole and other oilfield service applications. These elements will have better performance, as compared to conventional counterparts, where one or more of the following conditions exist: 1) a differential pressure applied across polymeric component; 2) high temperature; 3) high pressure; 4) presence of low molecular weight molecules and gases such as methane, carbon dioxide, and hydrogen sulfide, and the like.

Furthermore, the addition of functionalized graphene sheets, exfoliated graphitic nanoflakes and/or nanoplatelets with either high aspect ratio may simultaneously enhance the electrical conductivity and barrier properties of the polymeric matrix, and therefore the oilfield elements. As a result, oilfield elements including semiconducting and permeability resistant shields in wire and cable applications, and in all other electrical and electronic components in oilfield applications, may be produced which meet one or both of these requirements. Exemplary uses of such composites include packaging or enclosures for electronics such as sensors, multi-chip modules (MCM), and the like.

Advantages of embodiments of the invention may include one or more of the followings. The use of exfoliated or expanded graphitic materials, particularly functionalized graphene sheets (e.g., TEGO), offers a commercially feasible way to develop inexpensive polymer nanocomposites with good barrier and mechanical properties. Expanded graphite nanofillers are at least 500 times less expensive than carbon nanotubes and may offer comparable enhancements in mechanical properties at only a fractional cost of carbon nanotubes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An oilfield apparatus, comprising:

an oilfield element made of a composite comprising:

a matrix material; and a plurality of functionalized graphene sheets dispersed in the matrix material, wherein the oilfield apparatus is a downhole tool, wherein the plurality of functionalized graphene sheets comprise single-layer sheets and multi-layer sheets having a surface area per unit weight of at least 300 $m^2/g$, and wherein the plurality of functionalized graphene sheets are functionalized with polymers with a polydispersity index such that the polymer hinders folding of the plurality of functionalized graphene sheets.

2. The oilfield apparatus of claim 1, wherein the matrix material is a polymer or an elastomer.

3. The oilfield apparatus of claim 1, wherein the functionalized graphene sheets comprise thermal exfoliated graphite oxide.

4. The oilfield apparatus of claim 1, wherein the polymers are attached to surfaces of the functionalized graphene sheets via atom transfer radical polymerization.

5. The oilfield apparatus of claim 1, wherein the polymers attached to surfaces of the functionalized graphene sheets comprise co-polymers or magnetic particles.

6. The oilfield apparatus of claim 1, wherein the functionalized graphene sheets have an aspect ratio greater than 100.

7. The oilfield apparatus of claim 1, wherein the oilfield element is selected from the group consisting of packer elements, submersible pump motor protector bags, sensor protectors, blow out preventer elements, sucker rods, O-rings, T-rings, gaskets, pump shaft seals, tube seals, valve seals, seals and insulators used in electrical components.

8. An oilfield element made of a composite comprising:

a matrix material; and a plurality of functionalized graphene sheets dispersed in the matrix material, wherein the oilfield element is configured for use in an oilfield apparatus, wherein the oilfield apparatus is a downhole tool, wherein the plurality of functionalized graphene sheets comprise single-layer sheets and multi-layer sheets having a surface area per unit weight of at least 300 $m^2/g$, and wherein the plurality of functionalized graphene sheets are functionalized with polymers with a polydispersity index such that the polymer hinders folding of the plurality of functionalized graphene sheets.

9. The oilfield element of claim 8, wherein the matrix material is a polymer or an elastomer.

10. The oilfield element of claim 8, wherein the functionalized graphene sheets comprise thermal exfoliated graphite oxide.

11. The oilfield element of claim 8, wherein the polymers are attached to surfaces of the functionalized graphene sheets via atom transfer radical polymerization.

12. The oilfield element of claim 8, wherein the polymers attached to surfaces of the functionalized graphene sheets comprise co-polymers or magnetic particles.

13. The oilfield element of claim 8, wherein the functionalized graphene sheets have an aspect ratio larger than 100.

14. The oilfield element of claim 8, wherein the oilfield element is selected from the group consisting of packer elements, submersible pump motor protector bags, sensor protectors, blow out preventer elements, sucker rods, O-rings, T-rings, gaskets, pump shaft seals, tube seals, valve seals, seals and insulators used in electrical components.

15. A method comprising:

selecting an oilfield apparatus having an oilfield element, wherein at least a portion of the oilfield element is made of a composite comprising a plurality of functionalized graphene sheets dispersed in a matrix material, wherein the oilfield apparatus is a downhole tool, wherein the plurality of functionalized graphene sheets comprise single-layer sheets and multi-layer sheets having a surface area per unit weight of at least 300 $m^2/g$, and wherein the plurality of functionalized graphene sheets are functionalized with polymers with a polydispersity index such that the polymer hinders folding of the plurality of functionalized graphene sheets; and using the oilfield apparatus in an oilfield operation, thereby exposing the oilfield element to an oilfield environment.

16. The method of claim 15, wherein the functionalized graphene sheets comprise thermal exfoliated graphite oxide.

17. The method of claim 15, wherein the functionalized graphene sheets have an aspect ratio larger than 100.

18. The method of claim 15, wherein the oilfield element is selected from the group consisting of packer elements, submersible pump motor protector bags, sensor protectors, blow out preventer elements, sucker rods, O-rings, T-rings, gaskets, pump shaft seals, tube seals, valve seals, seals and insulators used in electrical components.

* * * * *